US007958907B2

(12) United States Patent
Nishikawa et al.

(10) Patent No.: US 7,958,907 B2
(45) Date of Patent: Jun. 14, 2011

(54) FLUID PRESSURE CIRCUIT

(75) Inventors: Hiroyasu Nishikawa, Tokyo (JP); Sei Shimahara, Tokyo (JP)

(73) Assignee: Caterpillar S.A.R.L., Geneva (CH)

( * ) Notice: Subject to any disclaimer, the term of this patent is extended or adjusted under 35 U.S.C. 154(b) by 425 days.

(21) Appl. No.: 12/065,112

(22) PCT Filed: Feb. 20, 2007

(86) PCT No.: PCT/JP2007/053029

§ 371 (c)(1),
(2), (4) Date: Feb. 28, 2008

(87) PCT Pub. No.: WO2008/015802

PCT Pub. Date: Feb. 7, 2008

(65) Prior Publication Data

US 2009/0159143 A1 Jun. 25, 2009

(30) Foreign Application Priority Data

Jul. 31, 2006 (JP) ..... 2006-208554

(51) Int. Cl.
*F15B 13/043* (2006.01)

(52) U.S. Cl. ..... 137/596.16; 60/422; 91/515; 91/530

(58) Field of Classification Search ..... 137/596.16; 91/515, 530; 60/422
See application file for complete search history.

(56) References Cited

U.S. PATENT DOCUMENTS

| | | | | |
|---|---|---|---|---|
| 4,638,720 | A * | 1/1987 | McKee et al. | 91/522 |
| 5,125,232 | A * | 6/1992 | Arii et al. | 60/484 |
| 5,299,420 | A * | 4/1994 | Devier et al. | 60/403 |
| 6,393,838 | B1 * | 5/2002 | Moriya et al. | 60/422 |
| 6,431,050 | B1 * | 8/2002 | Hausman et al. | 91/526 |
| 6,810,663 | B2 * | 11/2004 | Konishi et al. | 60/421 |
| 2006/0147315 | A1 * | 7/2006 | Jang et al. | 417/213 |

FOREIGN PATENT DOCUMENTS

| | | |
|---|---|---|
| JP | 5-81361 | 11/1993 |
| JP | 09-105154 | 4/1997 |
| JP | 09-235759 | 9/1997 |
| JP | 2002-339911 | 11/2002 |
| JP | 2004-245262 | 9/2004 |

* cited by examiner

*Primary Examiner* — Craig Schneider
(74) *Attorney, Agent, or Firm* — McDermott Will & Emery LLP

(57) ABSTRACT

A fluid pressure circuit that can, in either case where a first actuator that is fed from a first pump or a second actuator that is fed from a second pump is operated, by allowing feeding of the hydraulic fluid to a specific actuator from either the first or second pump, improve interlockability with the specific actuator. A control valve is incorporated with a plurality of first-group spools fed from a drive pump and a plurality of second-group spools fed from an idle pump. A solenoid selector valve unit switches a pilot line of a second-group tool controlling spool to a communicating state at the time of detection of a spool operation by a first pressure switch and switches a pilot line of a first-group tool controlling spool to a communicating state at the time of detection of a spool operation by a second pressure switch.

4 Claims, 15 Drawing Sheets

PRIOR ART

PRIOR ART

PRIOR ART

PRIOR ART

PRIOR ART

PRIOR ART

FLUID PRESSURE CIRCUIT

This is a U.S. national phase application under 35 U.S.C. §371 of International Patent Application No. PCT/JP2007/053029 filed Feb. 20, 2007, and claims the benefit of Japanese Application No. 2006-208554, filed Jul. 31, 2006. The International application has not yet been published at the time of this application. However, the contents of both these applications are incorporated herein in their entireties.

TECHNICAL FIELD

The present invention relates to a fluid pressure circuit that feeds hydraulic fluid to a plurality of actuators through a plurality of spools from a plurality of pumps.

BACKGROUND ART

There is provided a hydraulic circuit of a work machine enabled to correspond to required flow rates for various attachment tools by controlling a tool control valve, a first confluence valve, and a second confluence valve of the work machine by operating a solenoid selector valve of a selecting means and thereby selectively feeding a flow rate of a first pump, a confluent flow rate of first and second pumps, or a confluent flow rate of first, second, and third pumps (see Japanese Laid-Open Patent Publication No. 2004-245262, e.g., Page 5, FIG. 1).

As shown in FIG. 9, for a work machine A, on a lower structure 1 to be driven by left and right travel motors 1*tr*, an upper structure 2 is provided so as to be rotatable by a swing motor 2*sw*, and work equipment 3 is mounted on this upper structure 2. For the work equipment 3, pivotally supported on the upper structure 2 is a boom 4 to be pivoted by a boom cylinder 4*bm*, pivotally supported on a front end portion of this boom 4 is a stick 5 to be pivoted by a stick cylinder 5*st*, and pivotally supported on a front end portion of this stick 5 is an attachment tool 6 to be pivoted by a bucket cylinder 6*bk* in place of an original bucket.

The attachment tool 6 includes a type provided with a tool actuator 6*at*, such as a crusher hydraulic cylinder, that reciprocatively operates upon receiving hydraulic oil fed bidirectionally and a type provided with a tool actuator, such as a hydraulic breaker, that reciprocatively operates by an internal selector valve mechanism upon receiving hydraulic oil fed unidirectionally.

In such a work machine A, for a hydraulic circuit that operates the fluid pressure actuator such as a boom cylinder 4*bm*, as shown in FIG. 10, feed ports of a control valve 16 are communicated with a drive pump 12 and an idle pump 13 that sucks and discharges hydraulic oil serving as hydraulic fluid in a tank 11 via pump lines 14 and 15, and the control valve 16 is incorporated internally with a travel motor controlling spool, a swing motor controlling spool, boom cylinder controlling spools 16*bm* and 16*bm*2, a stick cylinder controlling spool, a bucket cylinder controlling spool, and tool controlling spools 16*at*1 and 16*at*2.

The boom cylinder controlling spools 16*bm* and 16*bm*2 are both for direction control and speed control of the boom cylinder 4*bm*, the tool controlling spools 16*at*1 and 16*at*2 are both for direction control and speed control of the tool actuator 6*at*, and these spools are provided two each so as to secure a large flow rate necessary for obtaining a required operation speed.

As shown in FIG. 10 and FIG. 11, the tool actuator 6*at* is operated by two pumps (drive pump 12 and idle pump 13) in an open-center circuit, even when a boom-up operation of the boom cylinder 4*bm* is intended, since the boom operating pressure of the boom cylinder 4*bm* is higher than the tool operating pressure, discharged flows from the drive pump 12 and the idle pump 13 all flow to the tool actuator 6*at* having a low load pressure, and interlockability between a tool operation and a boom-up operation is lost.

Therefore, even when the tool actuator 6*at* is operated by two pumps (drive pump 12 and idle pump 13) as shown in FIG. 12 and FIG. 13, for a boom-up operation of the boom cylinder 4*bm*, a pilot pressure line to one tool controlling spool 16*at*1 is forcibly controlled, one pump (idle pump 13) is made to operate the tool actuator 6*at* via the other tool controlling spool 16*at*2, and the other pump (drive pump 12) is allocated to the boom cylinder 4*bm* through the boom cylinder controlling spool 16*bm*, whereby interlockability between the boom cylinder 4*bm* and the tool actuator 6*at* is improved.

In this case, by three solenoid selector valves 27*s*1, 27*s*2, and 27*s*3 as shown in FIG. 14 and FIG. 15, four ports of the two tool controlling spools 16*at*1 and 16*at*2 are controlled for a change between one pump and two pumps and between a unidirectional feed and a bidirectional feed as shown in the following Table 1. Here, an overall description of the circuit diagram is omitted, as this will be described in detail based on FIG. 1.

TABLE 1

| | | 1P/2P | | Unidirection/ Bidirection | | |
|---|---|---|---|---|---|---|
| | | SOL1 | SOL2 | SOL3 | EC1 | EC2 |
| Tool setting | 1P unidirectional feed | x | x | x | ○ | ○ |
| | 1P bidirectional feed | x | x | ○ | x | x |
| | 2P unidirectional feed | ○ | ○ | x | ○ | ○ |
| | 2P bidirectional feed | ○ | ○ | ○ | x | x |

For example, as shown in FIG. 14, in a case of one pump and a bidirectional feed, by turning on the solenoid selector valve 27*s*3, one tool controlling spool 16*at*2 is made bidirectionally operable, so that the opening/closing operation-type tool actuator 6*at* can be operated bidirectionally.

Moreover, as shown in FIG. 15, in a case of two pumps and a unidirectional feed, by turning on the solenoid selector valves 27*s*1 and 27*s*2 and turning on solenoid valves 46 and 49 in return passages, both tool controlling spools 16*at*1 and 16*at*2 are made unidirectionally operable, so that a large flow rate of hydraulic oil can be fed unidirectionally to the tool actuator 6*at* such as a hydraulic breaker.

SUMMARY OF THE INVENTION

However, in such a circuit configuration, one tool controlling spool 16*at*2 is always used, whereas the other tool controlling spool 16*at*1 can only be changed so as to be used or not used. For this reason, a pump that feeds hydraulic oil to the tool actuator 6*at* in the case of one-pump setting as shown in FIG. 14 is limited to the idle pump 13, which cannot be changed to the drive pump 12.

Therefore, interlockability between the boom cylinder 4*bm* that is operated by hydraulic oil fed mainly from the drive pump 12 and the tool actuator 6*at* in the case of one-pump setting operated by hydraulic oil fed from the idle pump 13 can be attained, however, interlockability between the actuator, for example, the stick cylinder 5*st*, controlled by a spool fed with hydraulic oil mainly from the idle pump 13 and the tool actuator 6*at* in the case of one-pump setting fed with hydraulic oil similarly from the idle pump 13 is lost.

In brief, in the case of interlock between the boom cylinder 4*bm* and the tool actuator 6*at*, the drive pump 12 can be allocated to the boom cylinder 4*bm*, and the idle pump 13, to the tool actuator 6*at*, as shown in FIG. 12 and FIG. 13, however, in the case of interlock between the stick cylinder 5*st* and the tool actuator 6*at*, since hydraulic oil is fed from the same idle pump 13, interlockability cannot be improved.

The present invention has been made in view of such a problem, and an object thereof is to provide a fluid pressure circuit that can, in either case where a first actuator that is fed with hydraulic fluid from a first pump or a second actuator that is fed with hydraulic fluid from a second pump is operated, by allowing feeding of the hydraulic fluid to a specific actuator from either the first pump or the second pump, improve interlockability between the specific actuator and the first actuator or the second actuator.

The invention relates to a fluid pressure circuit including: a control valve incorporated with a plurality of first-group spools fed with hydraulic fluid from a first pump and a plurality of second-group spools fed with hydraulic fluid from a second pump, capable of feeding the hydraulic fluid to a specific actuator through a first-group specific spool and a second-group specific spool, capable of feeding the hydraulic fluid to a first actuator through another first-group spool, and capable of feeding the hydraulic fluid to a second actuator through another second-group spool; a pilot valve that pilot-operates each spool of the control valve via a pilot line; a first detector that detects operation of another first-group spool of the control valve; a second detector that detects operation of another second-group spool of the control valve; and a solenoid selector valve unit that switches a pilot line of the specific second-group spool from an interrupting state to a communicating state at a time of detection of a spool operation by the first detector and switches a pilot line of the specific first-group spool from an interrupting state to a communicating state at a time of detection of a spool operation by the second detector.

The invention as set forth below relates to the fluid pressure circuit as set forth above, wherein the solenoid selector valve unit is provided with four solenoid selector valves corresponding to two pilot lines connected to both ends of the specific first-group spool and two pilot lines connected to both ends of the specific second-group spool, respectively.

The invention as set forth below relates to the fluid pressure circuit as set forth above, wherein the solenoid selector valve is a proportional solenoid valve that is displaced according to an input electrical signal.

The invention as set forth below relates to the fluid pressure circuit as set forth above, wherein the first actuator is a boom cylinder that operates a boom of work equipment in a work machine; the second actuator is a stick cylinder that operates a stick coupled to a front end of the boom; and the specific actuator is a tool actuator that operates an attachment tool coupled to a front end of the stick.

According to the invention, in either case where the first actuator that is fed with hydraulic fluid from the first pump or the second actuator that is fed with hydraulic fluid from the second pump is operated, by allowing feeding of the hydraulic fluid to the specific actuator from either the first pump or the second pump, interlockability between the specific actuator and the first actuator or the second actuator can be improved.

According to the invention as set forth below, by using the four solenoid selector valves and thereby controlling the specific first-group spool and the specific second-group spool bidirectionally, respectively, the flow rate of the hydraulic fluid fed to the specific actuator can be changed between one pump and two pumps and the direction of the hydraulic fluid fed to the specific actuator can be changed between a unidirection and a bidirection.

According to the invention as set forth below, by providing the solenoid selector valve as a proportional solenoid valve, a more detailed setting can be carried out, so that interlockability can further be improved.

According to the invention as set forth below, in either case where the boom cylinder that is fed with hydraulic fluid from the first pump or the stick cylinder that is fed with hydraulic fluid from the second pump is operated, by allowing feeding of the hydraulic fluid to the tool actuator from either the first pump or the second pump, interlockability between the attachment tool and the boom and interlockability between the attachment tool and the stick can be improved.

DETAILED DESCRIPTION OF THE INVENTION

Figure 7:
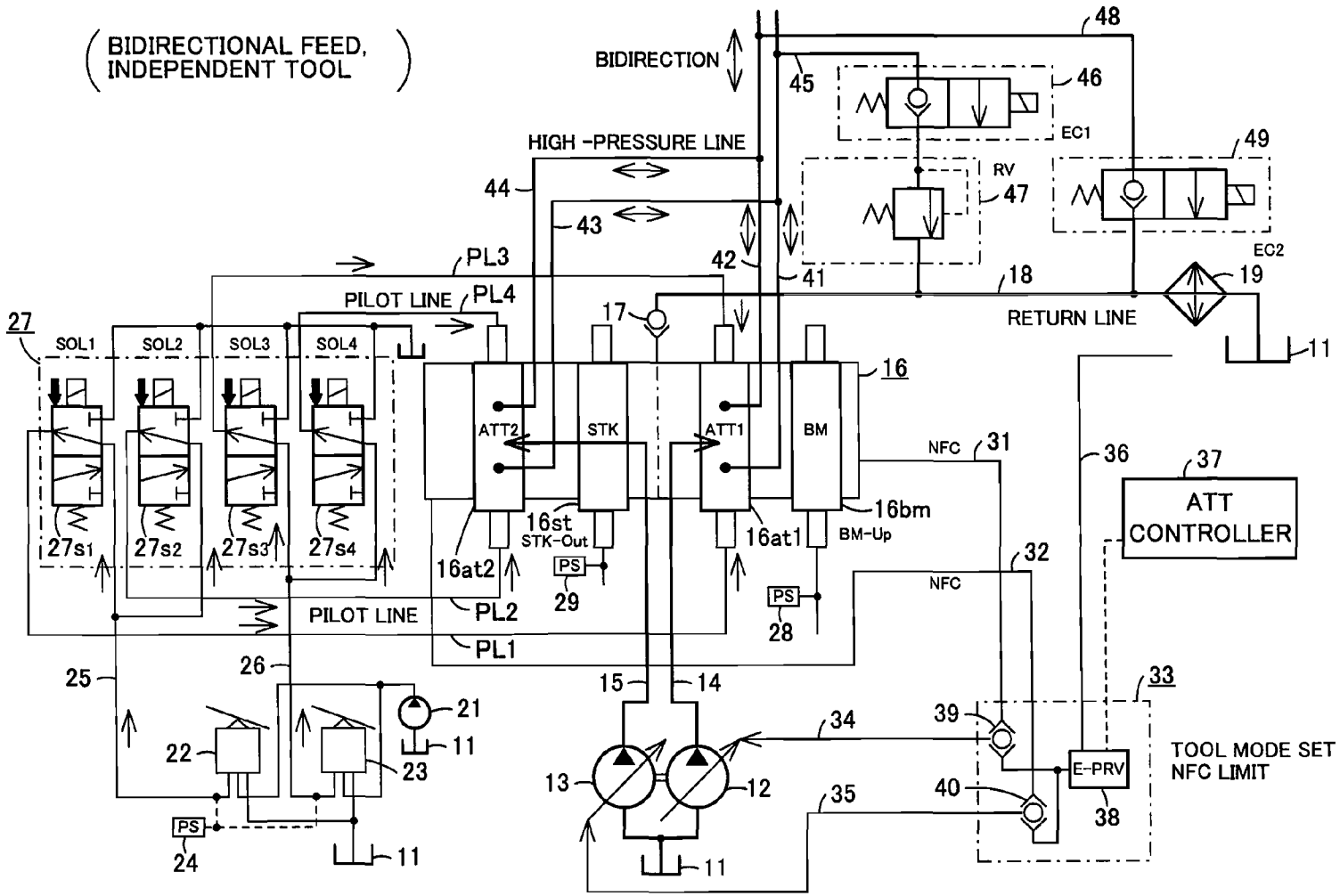
FIG. 7 A fluid pressure circuit diagram showing a condition of a bidirectional feed and an independent tool operation of the same circuit as the above.
Figure 8:
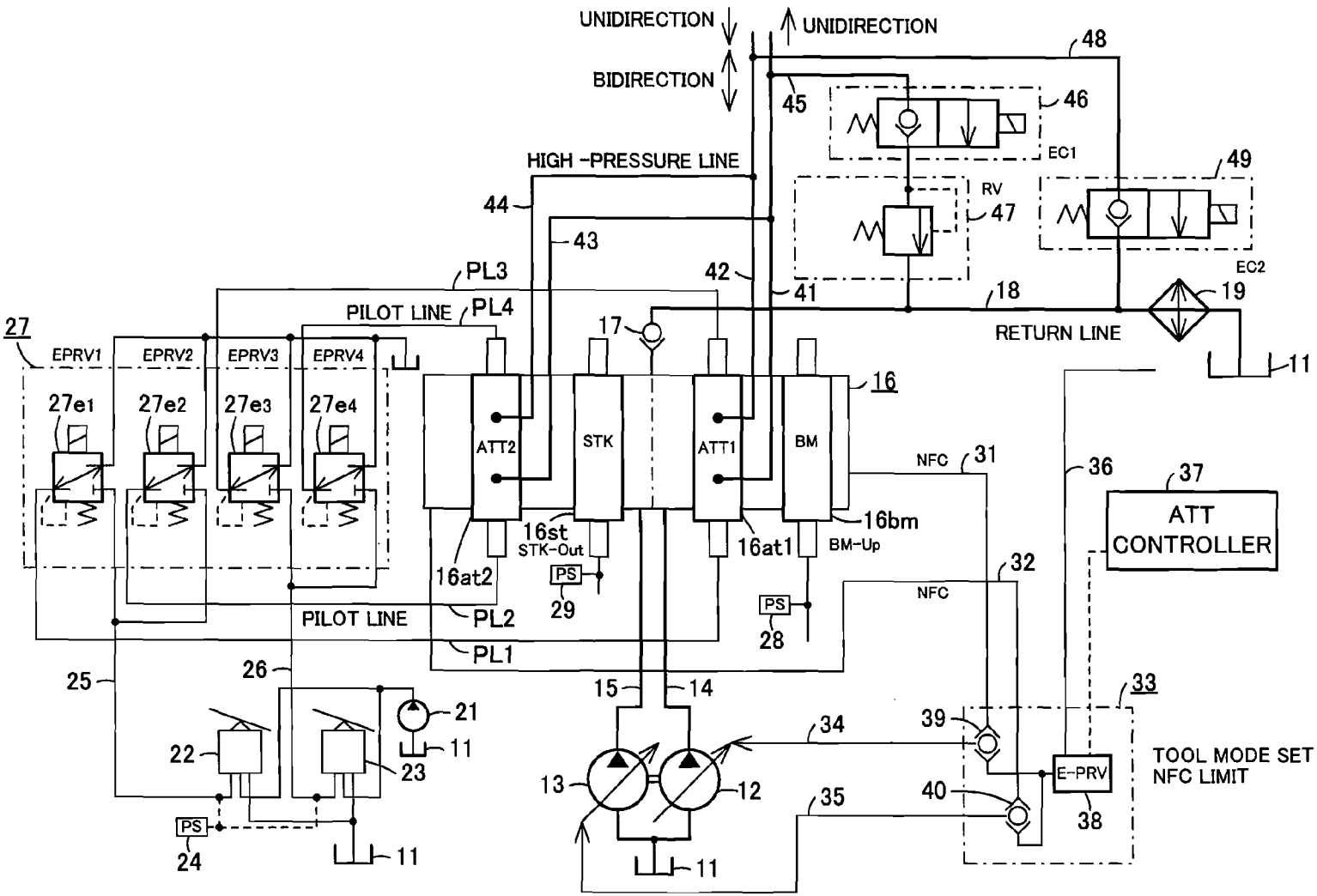
FIG. 8 A fluid pressure circuit diagram showing a second embodiment of a fluid pressure circuit according to the present invention.

Hereinafter, the present invention will be described in detail while referring to an embodiment shown in FIG. 1 to FIG. 7, another embodiment as shown in FIG. 8, and a work machine A shown in FIG. 9.

Figure 9:
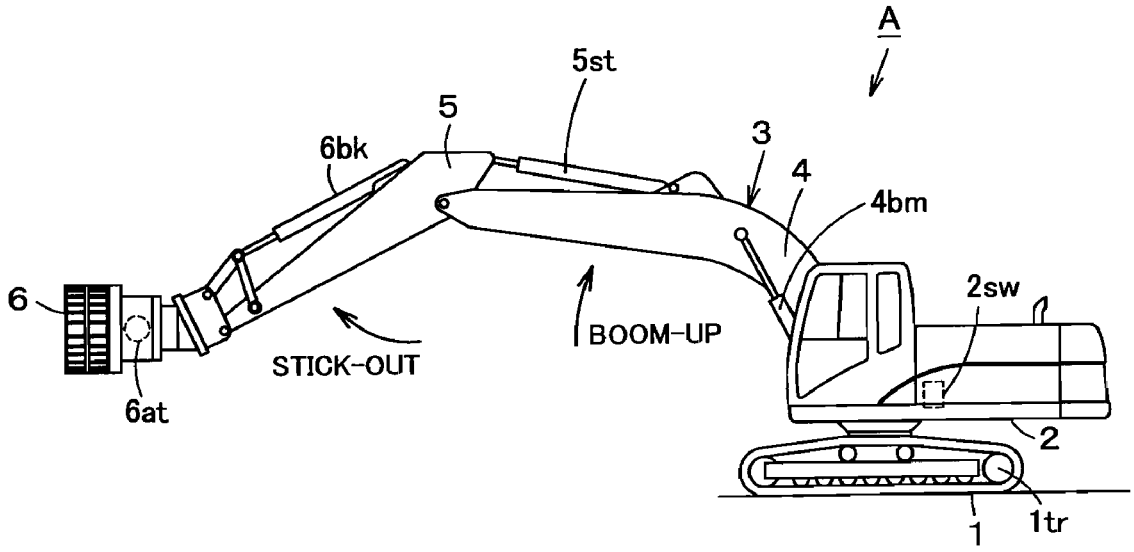
FIG. 9 A side view of a work machine mounted with the same fluid pressure circuit as the above.
Figure 10:
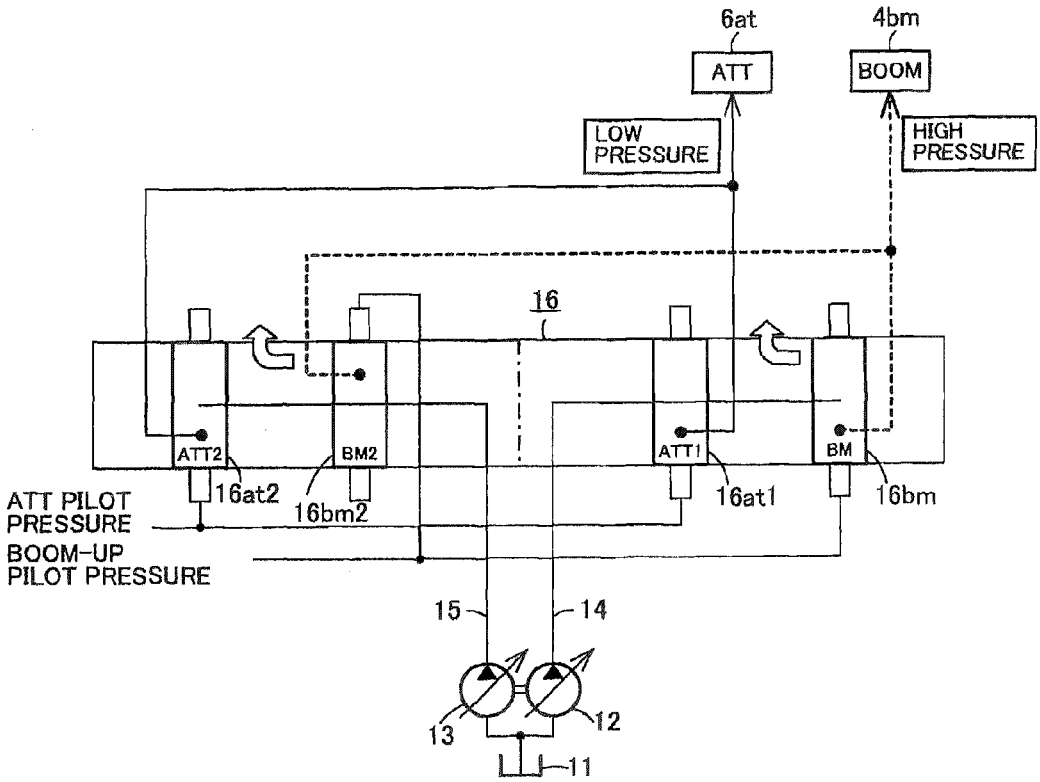
FIG. 10 An explanatory view showing a conventional boom/attachment tool circuit.
Figure 11:
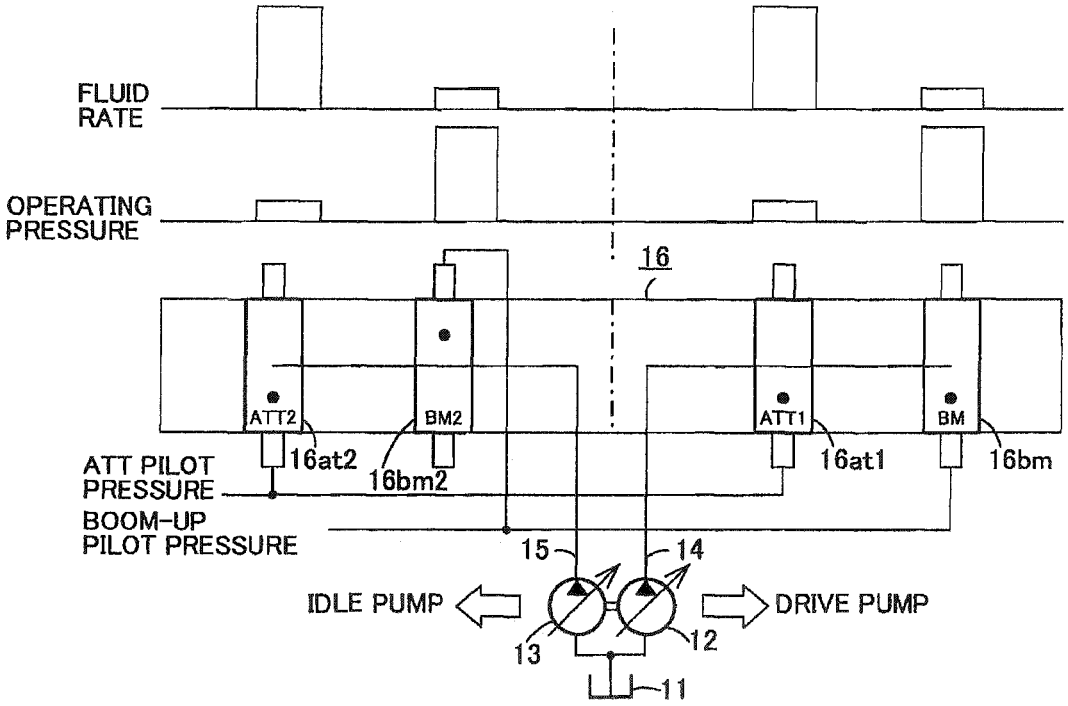
FIG. 11 An explanatory view showing a fluid rate and operating pressure condition of the conventional boom/attachment tool circuit.
Figure 12:
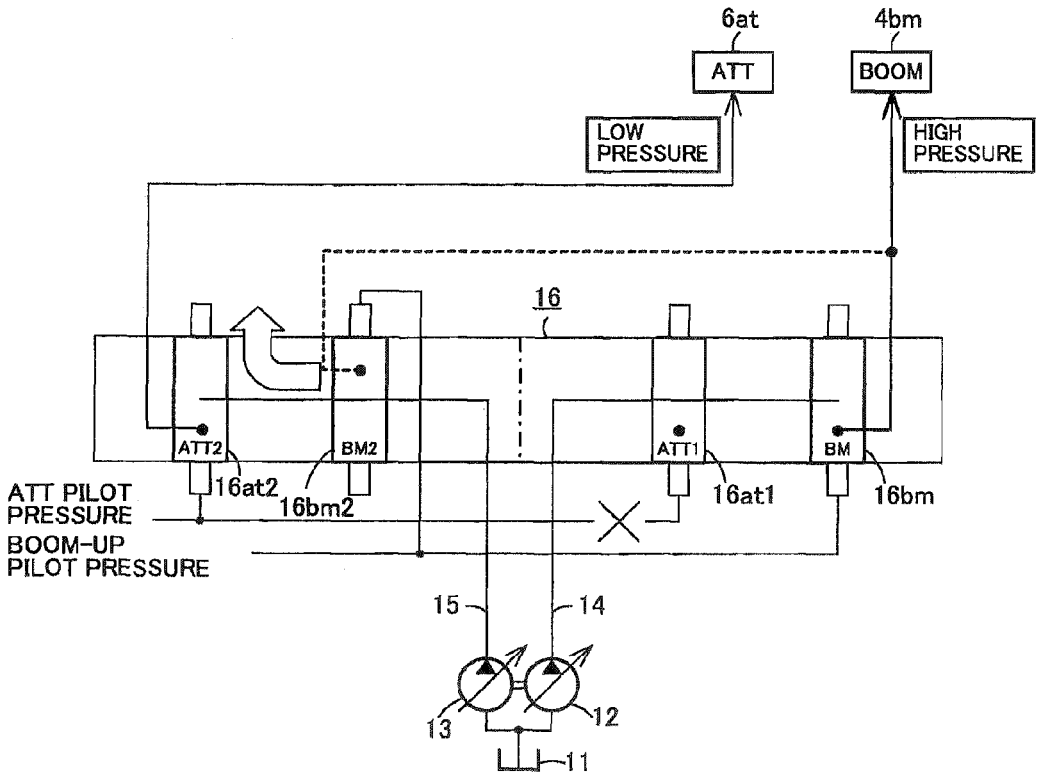
FIG. 12 An explanatory view showing a conventional boom/attachment tool interlockability improving circuit.
Figure 13:
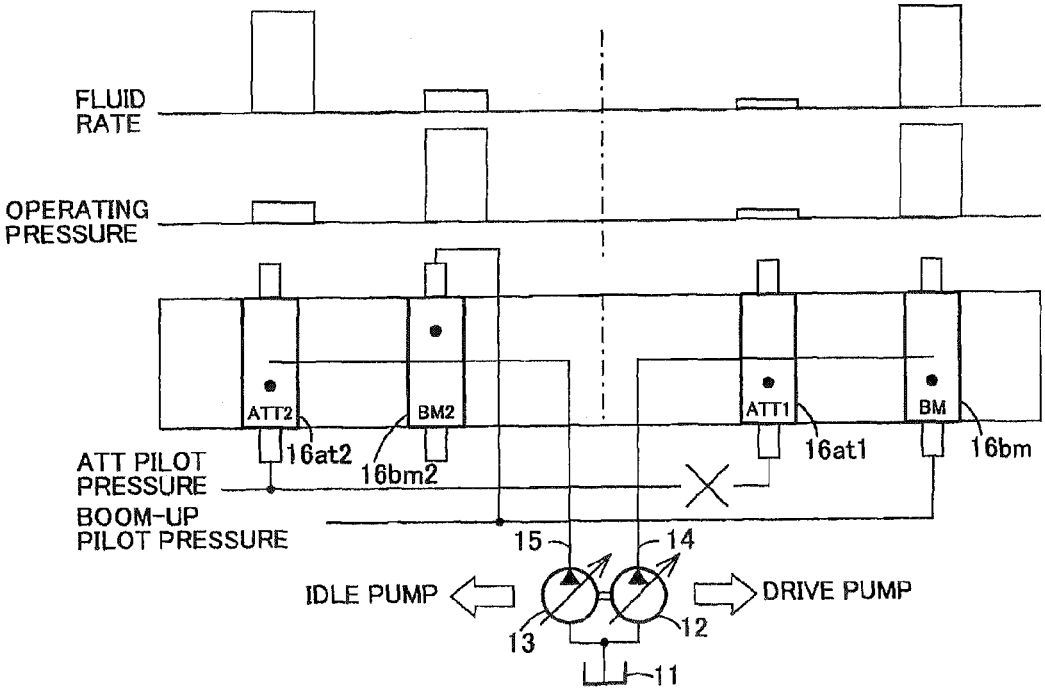
FIG. 13 An explanatory view showing a fluid rate and operating pressure condition of the conventional boom/attachment tool interlockability improving circuit.
Figure 14:
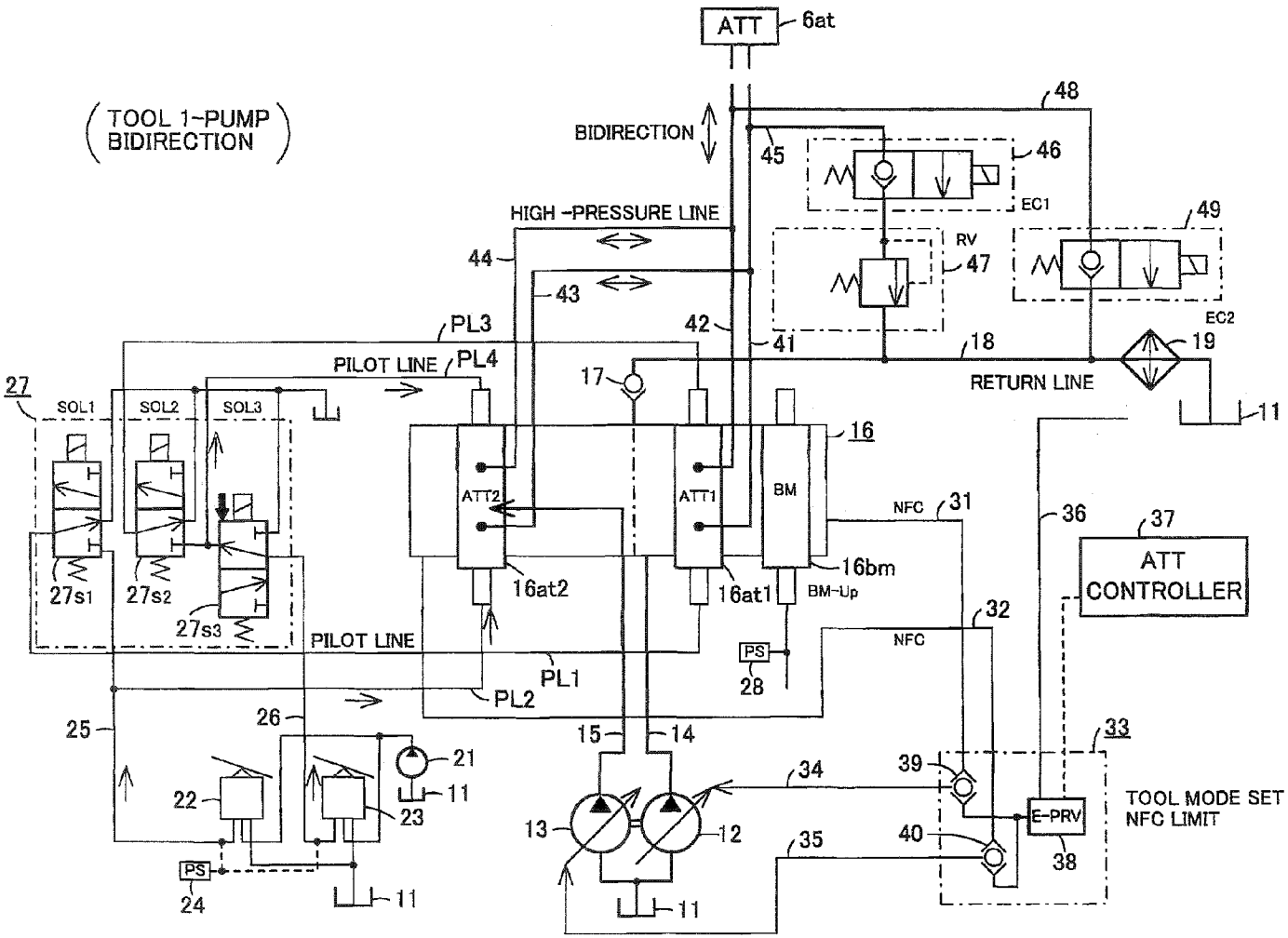
FIG. 14 A fluid pressure circuit diagram showing a tool 1-pump/bidirectional feed condition of the conventional boom/attachment tool interlockability improving circuit.
Figure 15:
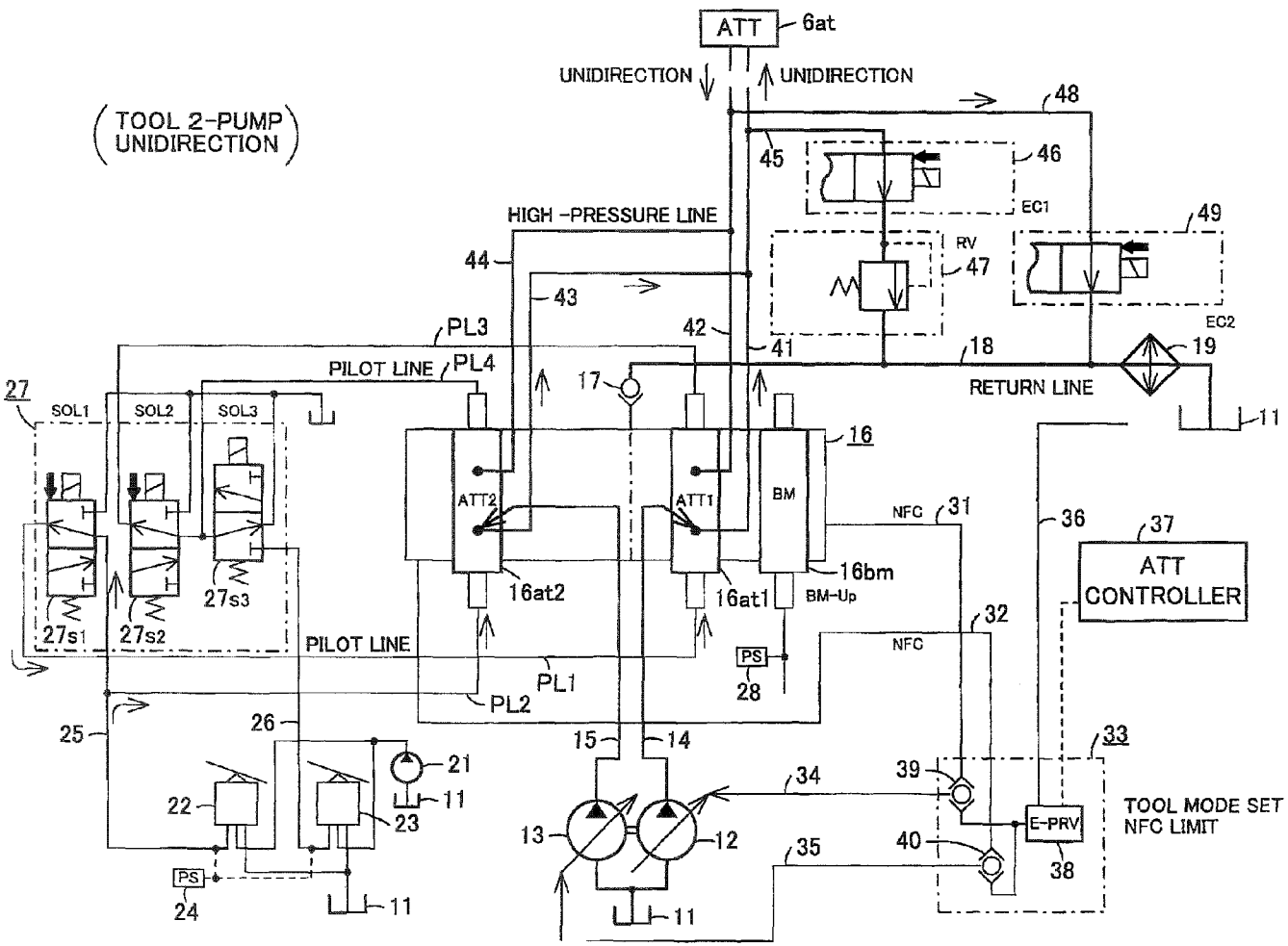
FIG. 15 A fluid pressure circuit diagram showing a tool 2-pump/unidirectional feed condition of the conventional boom/attachment tool interlockability improving circuit.

Although details of the work machine A shown in FIG. 9 are herein omitted, as these have already been described, the boom 4 of the work equipment 3 in the work machine A is operated by the boom cylinder 4*bm* serving as a first actuator, the stick 5 coupled to a front end of the boom is operated by the stick cylinder 5*st* serving as a second actuator, and the attachment tool 6 coupled to a front end of the stick 5 is operated by the tool actuator 6*at* serving as a specific actuator.

Figure 1:
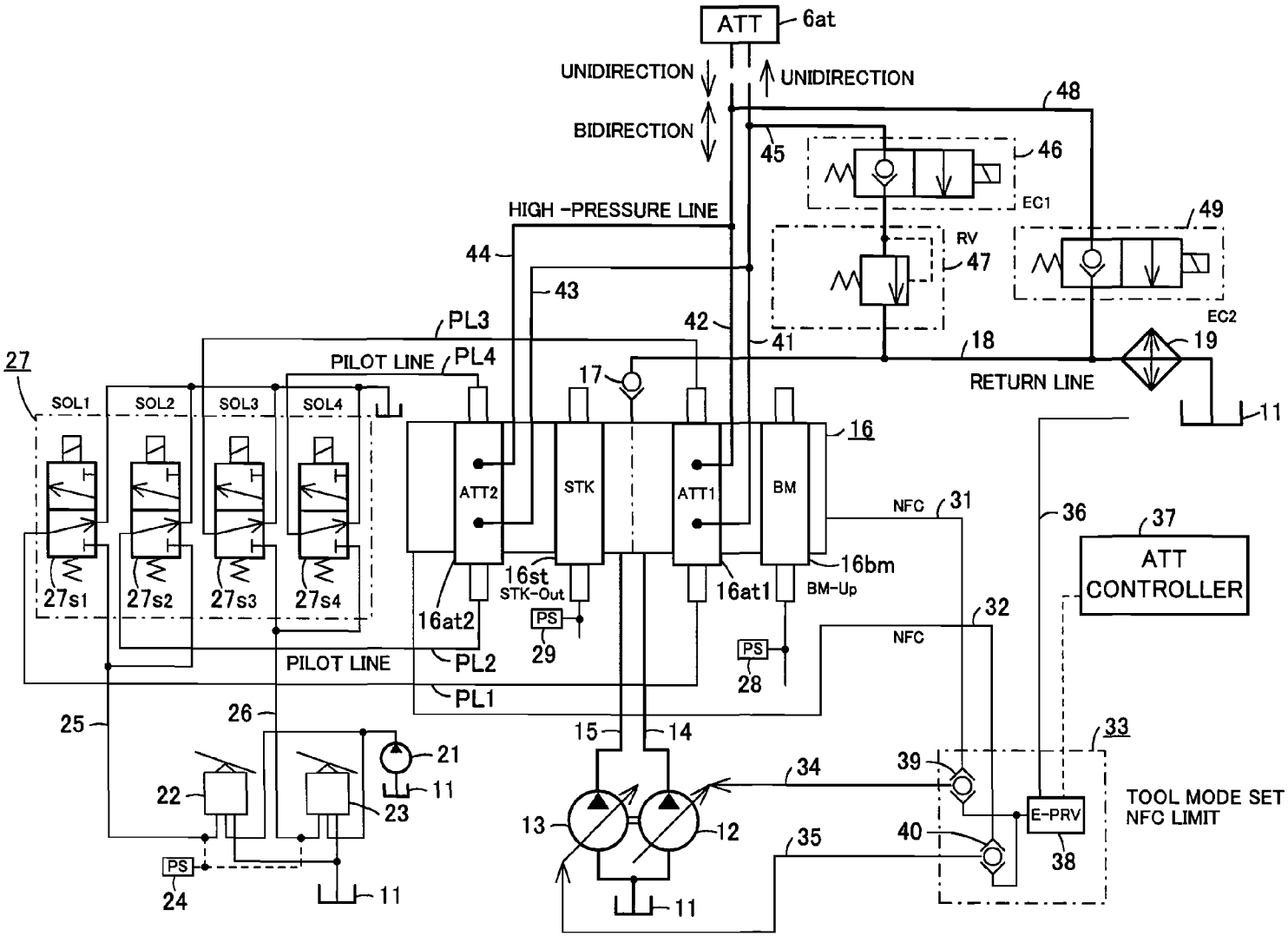
FIG. 1 A fluid pressure circuit diagram showing an embodiment of a fluid pressure circuit according to the present invention.

FIG. 1 shows the embodiment of a fluid pressure circuit, wherein a tank 11 that stores hydraulic fluid (that is, hydraulic oil) is connected with a suction port of the drive pump 12 serving as a first pump directly driven by an on-vehicle engine and a suction port of the idle pump 13 serving as a second pump indirectly driven via this drive pump 12, respectively. Discharge ports of the drive pump 12 and the idle pump 13 are communicated with a feed port of a control valve 16 through pump lines 14 and 15. A drain port of the control valve 16 is connected to a return line 18 via a check valve 17, and is further communicated with the tank 11 through an oil cooler 19.

The control valve 16 is incorporated with a first group of spools 16*bm* and 16*at*1 fed with hydraulic fluid from the drive pump 12 and a second group of spools 16*st* and 16*at*2 fed with hydraulic fluid from the idle pump 13, and is capable of feeding the hydraulic fluid to the tool actuator 6*at* through the tool controlling spool 16*at*1 serving as a first-group specific spool and the tool controlling spool 16*at*2 serving as a second-group specific spool. Furthermore, the control valve 16 is capable of feeding the hydraulic fluid to the boom cylinder 4*bm* through a boom spool 16*bm* serving as the other first-group spool, and is capable of feeding the hydraulic fluid to the stick cylinder 5*st* through a stick spool 16*st* serving as the other second-group spool.

A discharge port of a pilot pump 21 driven by the on-vehicle engine together with the drive pump 12 and the idle pump 13 is connected, through a pilot primary pressure line, to feed ports of pilot valves 22 and 23 operated by an operator of the work machine A, and output ports of these pilot valves 22 and 23 are connected with a pressure switch 24, and is connected with a solenoid selector valve unit 27 via pilot secondary pressure lines 25 and 26.

The solenoid selector valve unit 27 is provided with four solenoid selector valves 27*s*1, 27*s*2, 27*s*3, and 27*s*4 corresponding to pilot lines PL1 and PL3 serving as two pilot secondary pressure lines connected to both ends of the first-group tool controlling spool 16*at*1 and pilot lines PL2 and PL4 serving as two pilot secondary pressure lines connected to both ends of the second-group tool controlling spool 16*at*2, respectively. These solenoid selector valves 27*s*1, 27*s*2, 27*s*3, and 27*s*4 are valves switched on and off depending on the presence and absence of an input electrical signal.

The tool controlling spools 16*at*1 and 16*at*2 of the control valve 16 are pilot-operated, through the pilot lines PL1, PL2, PL3, and PL4 communicated by the solenoid selector valves 27*s*1, 27*s*2, 27*s*3, and 27*s*4, by a pilot secondary pressure fed from the pilot valves 22 and 23, while the other spools 16*bm* and 16*st* of the control valve 16 are pilot-operated, through always-communicated pilot lines (not shown), by a pilot secondary pressure fed from corresponding pilot valves (not shown).

In a boom-up-side pilot line of the boom spool 16*bm*, provided is a pressure switch 28 serving as a first detector that detects a boom-up instruction pressure to the boom spool 16*bm*, and in a stick-out-side pilot line of the stick spool 16*st*, provided is a pressure switch 29 serving as a second detector that detects a stick-out instruction pressure to the stick spool 16*st*.

Here, not only at the stick-out-side pilot line, but it is also possible, as the case may be, to add the stick-in-side pilot.

The solenoid selector valve unit 27 is controlled, by an unillustrated controller, so as to switch the pilot lines PL2 and PL4 of the second-group tool controlling spool 16*at*2 from an interrupting state to a communicating state for a spool operation detection by the first pressure switch 28 and so as to switch the pilot lines PL1 and PL3 of the first-group tool controlling spool 16*at*1 from an interrupting state to a communicating state for a spool operation detection by the second pressure switch 29.

Between the control valve 16 and pump capacity varying means (swash plates or the like) of the drive pump 12 and the idle pump 13, provided are lines 31 and 32 that feed back a negative control pressure generated in a center bypass passage within the control valve 16 to the pump capacity varying means, a control means 33, and lines 34 and 35. The control means 33 controls a pilot pressure fed through a pilot line 36 from the pilot pump 21 by a proportional solenoid valve 38 operated by a tool mode signal set by a controller 37 and feeds the pilot pressure to the lines 34 and 35 from shuttle valves 39 and 40.

For attachment output lines, an output line 41 and an output line 42 from the first-group tool controlling spool 16*at*1 are integrated with an output line 43 and an output line 44 from the second-group tool controlling spool 16*at*2, respectively, and these output lines are connected to the tool actuator 6*at*.

A return line 45 branched off from one output line is connected to the return line 18 via an open/close-type solenoid valve 46 and a relief valve 47. Furthermore, a return line 48 branched off from the other output line is connected to the return line 18 via an open/close switch-type solenoid valve 49.

Next, actions of the embodiment shown in FIG. 1 will be described with reference to FIG. 1 to FIG. 7 and the following Table 2 and Table 3. Table 2 shows a case of priority setting for the boom 4 or the stick 5 over the attachment tool 6, and Table 3 shows a case where the attachment tool 6 is interlocked with the boom 4 or the stick 5.

TABLE 2

| | | SOL1 | SOL2 | SOL3 | SOL4 | EC1 | EC2 |
|---|---|---|---|---|---|---|---|
| Tool setting | (1) BKT no tool | x | x | x | x | x | x |
| | (2) 1P unidirectional feed (BM priority) | x | ○ | x | x | ○ | ○ |
| | (3) 1P unidirectional feed (STK priority) | ○ | x | x | x | ○ | ○ |
| | (4) 1P bidirectional feed (BM priority) | x | ○ | x | ○ | x | x |
| | (5) 1P bidirectional feed (STK priority) | ○ | x | ○ | x | x | x |
| | (6) 2P unidirectional feed | ○ | ○ | x | x | ○ | ○ |
| | (7) 2P bidirectional feed | ○ | ○ | ○ | ○ | x | x |

TABLE 3

| | | | SOL1 | SOL2 | SOL3 | SOL4 | EC1 | EC2 |
|---|---|---|---|---|---|---|---|---|
| Priority switching in 2P unidirectional feed condition | (8) | Independent tool operation | ○ | ○ | x | x | ○ | ○ |
| | (9) | Interlock with BM | x | ○ | x | x | ○ | ○ |
| | (10) | Interlock with STK | ○ | x | x | x | ○ | ○ |
| | (11) | Interlock with BM + STK (BM priority) | x | ○ | x | x | ○ | ○ |
| | (12) | Interlock with BM + STK (STK priority) | ○ | x | x | x | ○ | ○ |
| Priority switching in 2P bidirectional feed condition | (13) | Independent tool operation | ○ | ○ | ○ | ○ | x | x |
| | (14) | Interlock with BM | x | ○ | x | ○ | x | x |
| | (15) | Interlock with STK | ○ | x | ○ | x | x | x |
| | (16) | Interlock with BM + STK (BM priority) | x | ○ | x | ○ | x | x |
| | (17) | Interlock with BM + STK (STK priority) | ○ | x | ○ | x | x | x |

FIG. 1 shows an unattached condition of the attachment tool 6 shown in Table 2 (1), and since it is not necessary to operate the tool actuator 6*at*, the solenoid selector valves 27*s*1, 27*s*2, 27*s*3, 27*s*4 and the solenoid valves 46 and 49 may remain off, that is, in a closed state.

Figure 2:
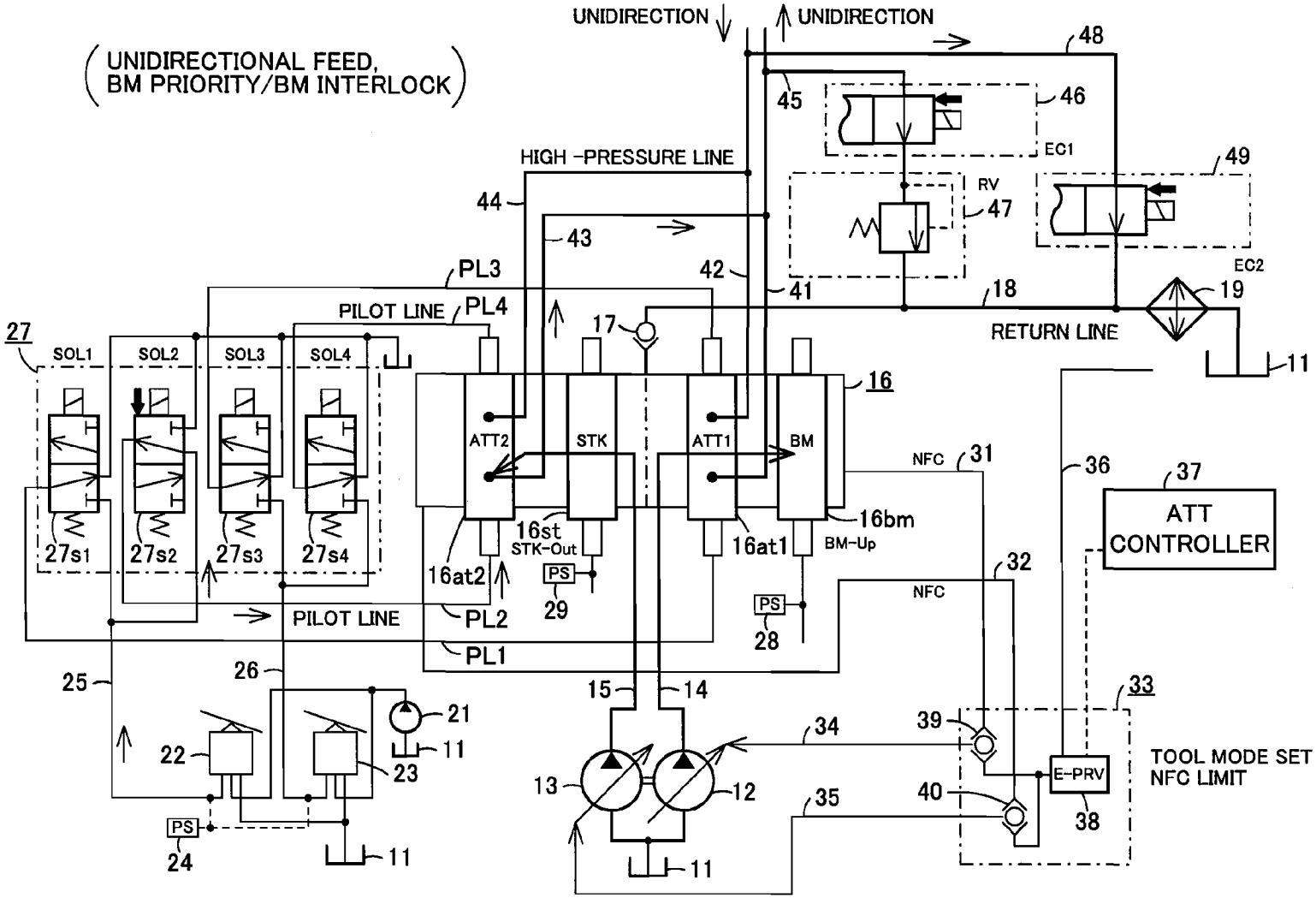
FIG. 2 A fluid pressure circuit diagram showing a condition of a unidirectional feed and boom priority or boom interlock of the same circuit as the above.

FIG. 2 shows a condition of a unidirectional feed and boom priority shown in Table 2 (2) or a condition of a unidirectional feed and boom interlock shown in Table 3 (9), which is a tool mode where the tool actuator 6*at* such as a hydraulic breaker that reciprocatively operates by an internal selector valve mechanism upon receiving hydraulic oil fed unidirectionally is attached to the front end of the stick 5, and when a boom-up operation is instructed, the hydraulic fluid discharged from the drive pump 12 is fed to a boom-up side of the boom cylinder 4*bm* through the boom spool 16*bm*, and the pressure switch 28 of the boom-up-side pilot line detects a boom-up pilot pressure, and thus based on the information, the unillustrated controller turns on the solenoid selector valve 27*s*2 and turns on the solenoid valves 46 and 49.

Here, switching of the solenoid selector valve 27*s*2 and the solenoid valves 46 and 49 can possibly be carried by selector switches, without limitation to detection of a boom-up pilot pressure.

Thereby, the hydraulic fluid discharged from the idle pump 13 is fed to the tool actuator 6*at* through the tool controlling spool 16*at*2 and the output line 43, and the fluid discharged from this tool actuator 6*at* is returned to the tank 11 through the solenoid valve 49 and the oil cooler 19 from the return line 48. At this time, a predetermined feed pressure is secured since there exists the relief valve 47 in the return line 45.

Figure 3:
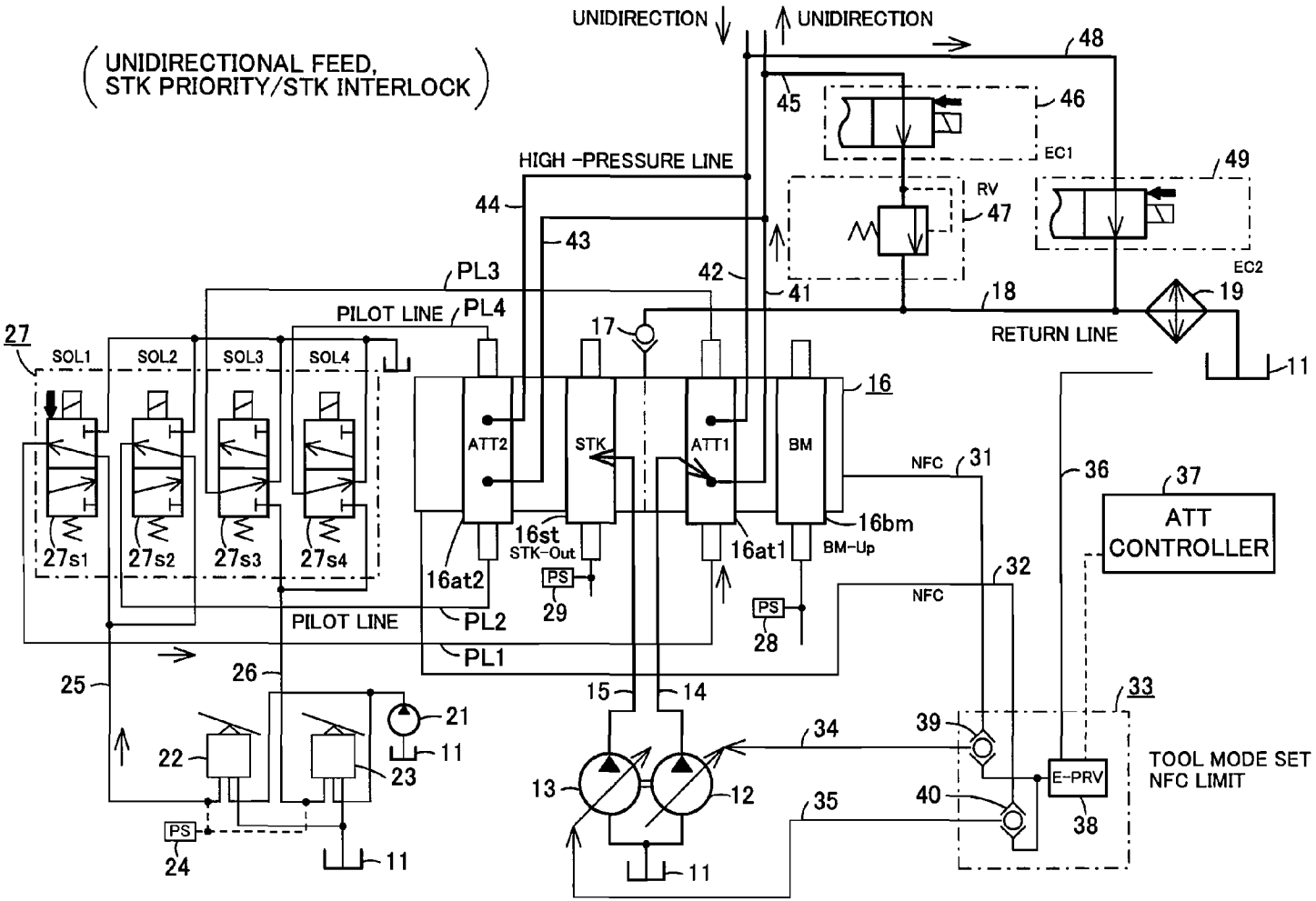
FIG. 3 A fluid pressure circuit diagram showing a condition of a unidirectional feed and stick priority or stick interlock of the same circuit as the above.

FIG. 3 shows a condition of a unidirectional feed and stick priority shown in Table 2 (3) or a condition of a unidirectional feed and stick interlock shown in Table 3 (10), which is a unidirectional feed-type tool mode of a hydraulic breaker or the like, and when a stick-out operation is instructed, the hydraulic fluid discharged from the idle pump 13 is fed to a stick-out side of the stick cylinder 5*st* through the stick spool 16*st*, and the pressure switch 29 of the stick-out-side pilot line detects a stick-out pilot pressure, and thus based on the information, the unillustrated controller turns on the solenoid selector valve 27*s*1 and turns on the solenoid valves 46 and 49.

Here, not only at the stick-out-side pilot line, but it is also possible, as the case may be, to add the stick-in-side pilot and carry out control in the same manner.

Thereby, the hydraulic fluid discharged from the idle pump 12 is fed to the tool actuator 6*at* through the tool controlling spool 16*at*1 and the output line 41, and the fluid discharged from this tool actuator 6*at* is returned to the tank 11 through the solenoid valve 49 and the oil cooler 19 from the return line 48.

Figure 4:
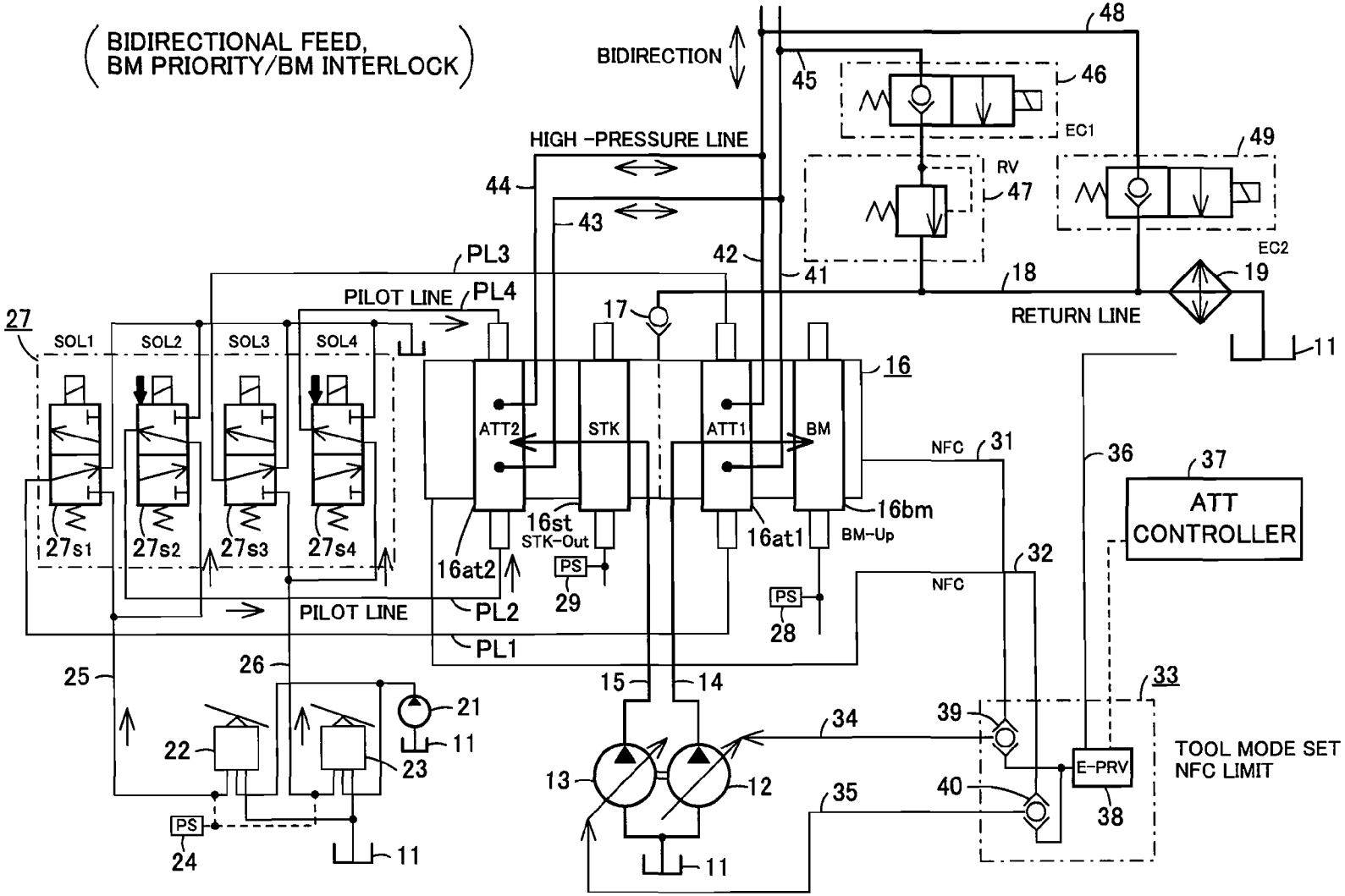
FIG. 4 A fluid pressure circuit diagram showing a condition of a bidirectional feed and boom priority or boom interlock of the same circuit as the above.

FIG. 4 shows a condition of a bidirectional feed and boom priority shown in Table 2 (4) or a condition of a bidirectional feed and boom interlock shown in Table 3 (14), which is a tool mode where the attachment tool 6 having the tool actuator 6*at* such as a crusher hydraulic cylinder that reciprocatively operates upon receiving hydraulic oil fed bidirectionally is attached to the front end of the stick 5, and when a boom-up operation is instructed, the hydraulic fluid discharged from the drive pump 12 is fed to a boom-up side of the boom cylinder 4*bm* through the boom spool 16*bm*, and the pressure switch 28 of the boom-up-side pilot line detects a boom-up pilot pressure, and thus based on the information, the unillustrated controller turns on the solenoid selector valves 27*s*2 and 27*s*4.

Thereby, the hydraulic fluid discharged from the idle pump 13 is fed to the tool actuator 6*at* through the tool controlling spool 16*at*2 and one of the output lines 43 and 44, and the fluid discharged from this tool actuator 6*at* is returned to the tool controlling spool 16*at*2 through the other of the output lines 43 and 44, and is returned to the tank 11 through the return line 18.

Figure 5:
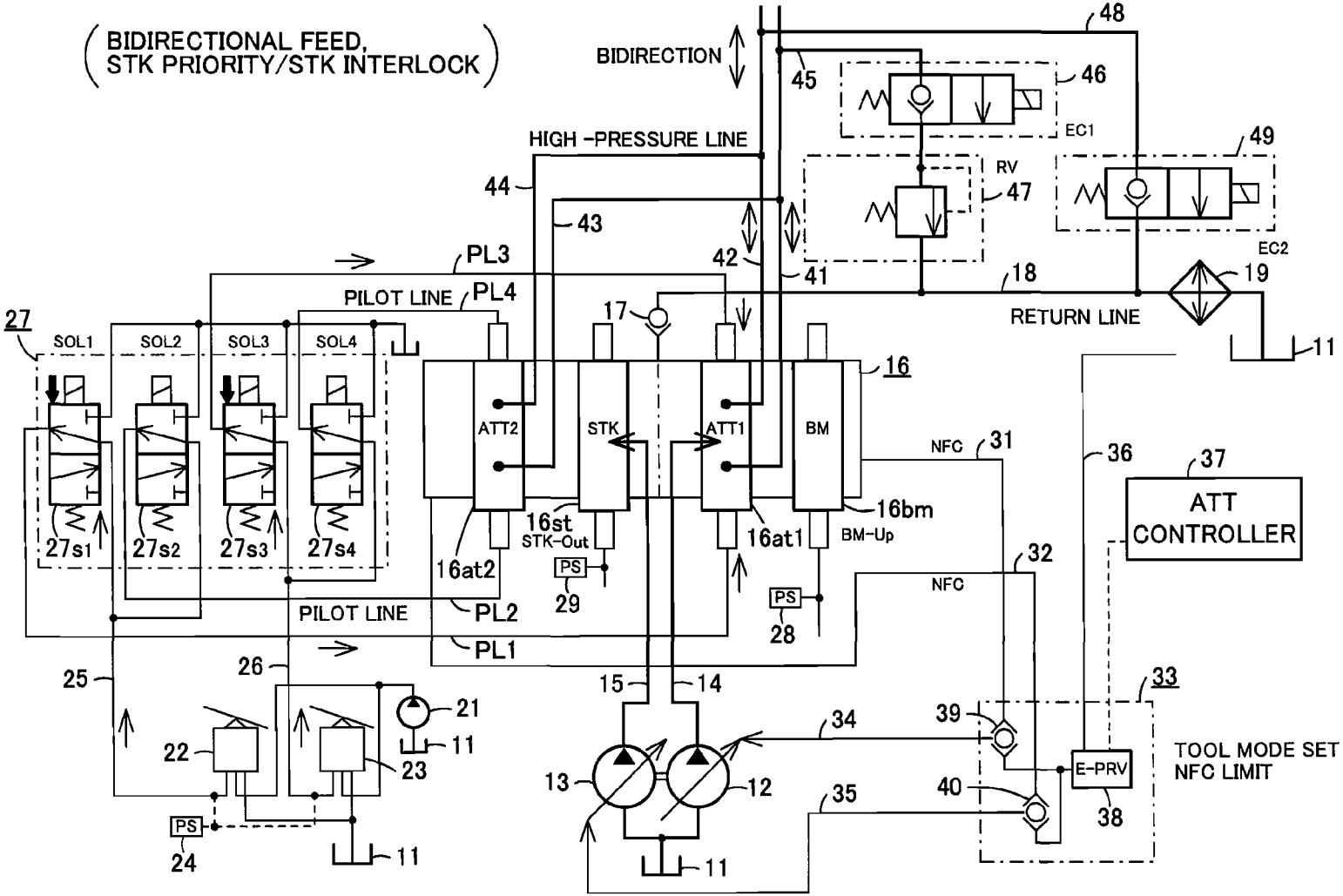
FIG. 5 A fluid pressure circuit diagram showing a condition of a bidirectional feed and stick priority or stick interlock of the same circuit as the above.

FIG. 5 shows a condition of a bidirectional feed and stick priority shown in Table 2 (5) or a condition of a bidirectional feed and stick interlock shown in Table 3 (15), which is a bidirectional feed-type tool mode of a crusher hydraulic cylinder or the like, and when a stick-out operation is instructed, the hydraulic fluid discharged from the idle pump 13 is fed to a stick-out side of the stick cylinder 5*st* through the stick spool 16*st*, and the pressure switch 29 of the stick-out-side pilot line detects a stick-out pilot pressure, and thus based on the information, the unillustrated controller turns on the solenoid selector valves 27*s*1 and 27*s*3.

Thereby, the hydraulic fluid discharged from the drive pump 12 is fed to the tool actuator 6*at* through the tool controlling spool 16*at*1 and one of the output lines 41 and 42, and the fluid discharged from this tool actuator 6*at* is returned to the tool controlling spool 16*at*1 through the other of the output lines 41 and 42, and is returned to the tank 11 through the return line 18.

Figure 6:
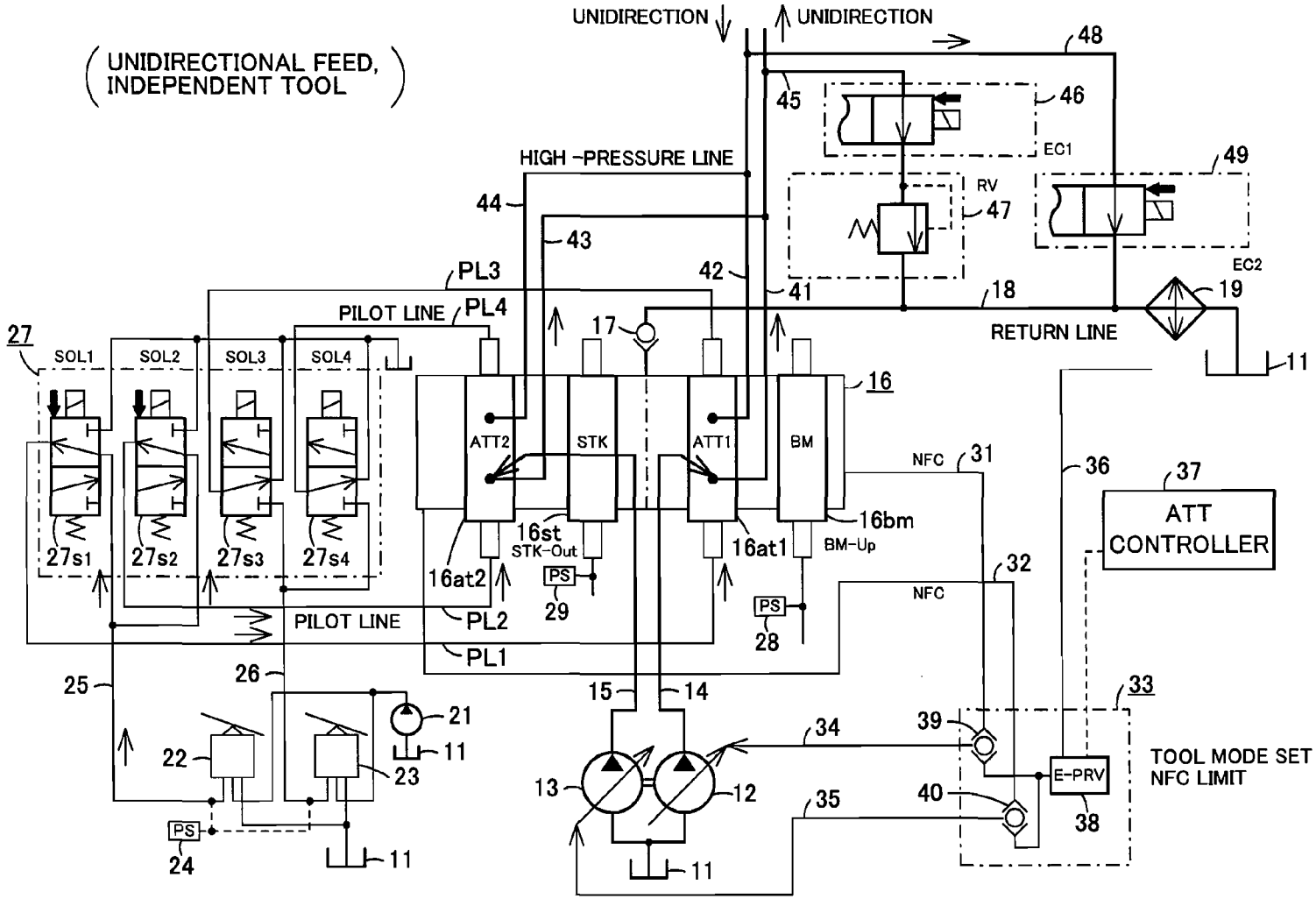
FIG. 6 A fluid pressure circuit diagram showing a condition of a unidirectional feed and an independent tool operation of the same circuit as the above.

FIG. 6 shows a condition of a unidirectional feed and independent tool operation shown in Table 2 (6) or Table 3 (8), and when the unidirectional feed-type tool actuator 6*at* such as a hydraulic breaker is operated independently, the unillustrated controller that has received pilot pressure absence signals from the pressure switches 28 and 29 turns on the solenoid selector valves 27*s*1 and 27*s*2 and turns on the solenoid valves 46 and 49.

Thereby, the hydraulic fluid discharged from the idle pump 12 is fed to the tool actuator 6*at* through the tool controlling spool 16*at*1 and the output line 41, the hydraulic fluid discharged from the idle pump 13 is fed to the tool actuator 6*at* through the tool controlling spool 16*at*2 and the output line 43, and the fluid discharged from this tool actuator 6*at* is returned to the tank 11 through the electromagnetic valve 49 and the oil cooler 19 from the return line 48.

FIG. 7 shows a condition of a bidirectional feed and independent tool operation shown in Table 2 (7) or Table 3 (13), and when the bidirectional feed-type tool actuator 6*at* such as a crusher hydraulic cylinder is operated independently, the unillustrated controller that has received pilot pressure absence signals from the pressure switches 28 and 29 turns on the solenoid selector valves 27*s*1, 27*s*2, 27*s*3, and 27*s*4.

Thereby, the hydraulic fluid discharged from the drive pump 12 is fed to the tool actuator 6*at* through the tool controlling spool 16*at*1 and one of the output lines 41 and 42, the hydraulic fluid discharged from the idle pump 13 is fed to the tool actuator 6*at* through the tool controlling spool 16*at*2 and one of the output lines 43 and 44, and the fluid discharged from this tool actuator 6*at* is returned the tool controlling spool 16*at*1 through the other of the output lines 41 and 42, is returned to the tool controlling spool 16*at*2 from the other of the output lines 43 and 44, and is returned to the tank 11 through the return line 18.

Thus, by using the four solenoid selector valves 27*s*1, 27*s*2, 27*s*3, and 27*s*4, the four ports of the two tool controlling spools 16*at*1 and 16*at*2 are controlled for a change between one pump and two pumps and between a unidirectional feed and a bidirectional feed.

Next, effects of the embodiment shown in FIG. 1 to FIG. 7 will be described.

In either case where the boom cylinder 4*bm* that is fed with hydraulic fluid from the drive pump 12 or the stick cylinder 5*st* that is fed with hydraulic fluid from the idle pump 13 is operated, by allowing feeding of the hydraulic fluid to the tool actuator 6*at* from either the drive pump 12 or the idle pump 13, interlockability between the attachment tool 6 and the boom 4 and interlockability between the attachment tool 6 and the stick 5 can be improved.

That is, since this fluid pressure circuit can freely use the two tool controlling spools 16*at*1 and 16*at*2, it becomes possible to freely change a using pump of the attachment tool 6 (drive pump 12/idle pump 13) in a case of one-pump setting, so that not only can interlocking operability between the attachment tool 6 and the boom 4 be improved, but interlocking operability between the attachment tool 6 and other work equipment members such as stick 5 can also be improved.

Moreover, by using the four solenoid selector valves 27*s*1, 27*s*2, 27*s*3, and 27*s*4 and thereby controlling the first-group tool controlling spool 16*at*1 and the second-group tool controlling spool 16*at*2 bidirectionally, respectively, the flow rate of the hydraulic fluid fed to the tool actuator 6*at* can be changed between the one pump and two pumps, and the hydraulic fluid feeding direction to the tool actuator 6*at* can be changed between a undidirection and a bidirection.

Furthermore, by providing the four solenoid selector valves 27*s*1, 27*s*2, 27*s*3, and 27*s*4 as on/off-type solenoid selector valves, control of these solenoid selector valves 27*s*1, 27*s*2, 27*s*3, and 27*s*4 is simplified.

Next, FIG. 8 shows another embodiment, wherein four solenoid selector valves in a solenoid selector valve unit 27 are provided as proportional solenoid valves 27*e*1, 27*e*2, 27*e*3, and 27*e*4. These proportional solenoid valves 27*e*1, 27*e*2, 27*e*3, and 27*e*4 can obtain internal passage opening areas according to the size of an electrical instruction signal from an unillustrated controller. Here, since the other parts are the same as those of the above embodiment shown in FIG. 1, description thereof is omitted.

Then, by providing solenoid selector valves of the solenoid selector valve unit 27 as the proportional solenoid valves 27*e*1, 27*e*2, 27*e*3, and 27*e*4, it becomes possible to carry out a more detailed setting than by the on/off-type solenoid selector valves, so that interlockability can further be improved.

Development of these embodiments makes it possible to individually control the pilot secondary pressures of attachment tool lines, and by installing a pressure switch on the pilot secondary pressure line of the control spool of a work equipment actuator whose interlocking operability is wished to be considered, a circuit with interlockability taken into consideration can be freely built, and it becomes possible to obtain operability with interlockability taken into consideration, that is, satisfactory interlocking operability in various attachment tool works.

That is, for operation detection of the work equipment actuator interlocking with the attachment tool 6, the pressure switches 28 and 29 are installed on the pilot secondary pressure lines of the actuator control spools thereof, and operation is judged by the presence and absence of a signal thereof, and thus, without limitation to the boom cylinder 4*bm* and the stick cylinder 5*st*, by installing the pressure switches 28 and 29 on the pilot secondary pressure lines of the control spools of other work equipment actuators (for example, a bucket cylinder 6*bk*, a swing motor 2*sw*, and the like) whose interlockability with the attachment tool 6 is considered, interlocking operability of various attachment tool works can be improved.

Here, it is also possible to provide the pressure switches 28 and 29 as pressure sensors.

The present invention can be applied to a work machine A such as a hydraulic excavator and can also be applied to other machines for which interlocking operability is required.

The invention claimed is:

1. A fluid pressure circuit comprising:

a control valve incorporated with a plurality of first-group spools fed with hydraulic fluid from a first pump and a plurality of second-group spools fed with hydraulic fluid from a second pump, wherein the control valve feeds the hydraulic fluid to one specific actuator through a first-group specific spool and a second-group specific spool, wherein the control valve feeds the hydraulic fluid to a first actuator through another first-group spool, and wherein the control valve feeds the hydraulic fluid to a second actuator through another second-group spool;

a pilot valve that pilot-operates each spool of the control valve via a pilot line;

a first detector that detects operation of another first-group spool of the control valve;

a second detector that detects operation of another second-group spool of the control valve; and a solenoid selector valve unit that switches a pilot line of the specific second-group spool from an interrupting state to a communicating state at a time of detection of a spool operation by the first detector and switches a pilot line of the specific first-group spool from an interrupting state to a communicating state at a time of detection of a spool operation by the second detector, wherein the solenoid selector valve unit is provided with four solenoid selector valves corresponding to two pilot lines connected to both ends of the specific first-group spool fed with hydraulic fluid from the first pump and two pilot lines connected to both ends of the specific second-group spool fed with hydraulic fluid from the second pump, respectively.

2. The fluid pressure circuit as set forth in claim 1, wherein the solenoid selector valve is a proportional solenoid valve that is displaced according to an input electrical signal.

3. The pressure circuit as set forth in claim 1, wherein the first actuator is a boom cylinder that operates a boom of work equipment in a work machine;

the second actuator is a stick cylinder that operates a stick coupled to a front end of the boom; and the specific actuator is a tool actuator that operates an attachment tool coupled to a front end of the stick.

4. The pressure circuit as set forth in claim 2, wherein the first actuator is a boom cylinder that operates a boom of work equipment in a work machine;

the second actuator is a stick cylinder that operates a stick coupled to a front end of the boom; and the specific actuator is a tool actuator that operates an attachment tool coupled to a front end of the stick.

* * * * *